United States Patent [19]

Hofmann

[11] 4,420,293

[45] Dec. 13, 1983

[54] LIQUID COOLED COMPRESSOR WITH IMPROVED LIQUID SEPARATION

[75] Inventor: Rudolf Hofmann, Diedenbergen, Fed. Rep. of Germany

[73] Assignee: Isartaler Schraubenkompressoren GmbH, Geretsried, Fed. Rep. of Germany

[21] Appl. No.: 189,815

[22] Filed: Sep. 23, 1980

[30] Foreign Application Priority Data

| | | | |
|---|---|---|---|
| Sep. 24, 1979 | [DE] | Fed. Rep. of Germany | 2938557 |
| Jun. 13, 1980 | [DE] | Fed. Rep. of Germany | 3022277 |
| Jun. 13, 1980 | [DE] | Fed. Rep. of Germany | 3022249 |
| Jun. 20, 1980 | [DE] | Fed. Rep. of Germany | 3023092 |
| Jul. 9, 1980 | [DE] | Fed. Rep. of Germany | 3026000 |

[51] Int. Cl.[3] ..... F04C 18/16; F04C 29/02

[52] U.S. Cl. ..... 418/47; 418/85; 418/89; 418/96; 418/97; 418/101; 418/201; 418/DIG. 1

[58] Field of Search ..... 418/85, 89, 96–100, 418/201, DIG. 1, 101, 47

[56] References Cited

U.S. PATENT DOCUMENTS

| | | | |
|---|---|---|---|
| 1,188,286 | 6/1916 | Leonard | 418/96 |
| 1,439,628 | 12/1922 | Kien | 418/85 |
| 1,561,364 | 11/1925 | Smith | 418/98 |
| 1,626,768 | 5/1927 | Vollmann | 418/DIG. 1 |
| 2,361,146 | 10/1944 | Montelius | 418/DIG. 1 |
| 3,669,579 | 6/1972 | Carter | 418/96 |
| 3,820,923 | 6/1974 | Zweifel | 418/DIG. 1 |
| 4,174,196 | 11/1979 | Mori et al. | 418/99 |

*Primary Examiner*—John J. Vrablik

*Attorney, Agent, or Firm*—Wood, Dalton, Phillips, Mason & Rowe

[57] ABSTRACT

A screw compressor with liquid injection wherein the units previously disposed separately from one another, such as the air filter, liquid separator, and so on, are integrated into a single housing. Various compartments are formed in the housing by means of partitions, such that the compartments provide for good separation of entrained liquid from the compressed air being achieved because of large flow cross-section, maximum utilization of the available flowpath and multiple deflection of the current of compressed air. The compact construction results in a substantially smaller overall compressor size than that of comparable known compressor plants, in a reduction of manufacturing cost and simplification of the assembly of a compressor plant.

10 Claims, 13 Drawing Figures

1d
1c
2
65
64
66
58
60
63
60
59
61
62
2

LIQUID COOLED COMPRESSOR WITH IMPROVED LIQUID SEPARATION

The invention relates to a compressor unit disposed within a housing and comprising a screw compressor cooled and lubricated by a liquid injected into the compression chamber, an air filter, a suction regulator, a liquid separator, and a liquid tank.

In previously constructed compressor units of this kind, the various components such as screw compressor, suction regulator, liquid separator, and the like, were separated within a sheet metal housing which surrounded the entire plant and interconnecting piping. This has the consequence that the overall construction of the compressor plant is bulky and entails high assembly costs. The end result is that compressor plants of this kind are economically used only for deliveries of 3000 liters per minute or more.

An object of this invention is that of constructing a compressor plant which can be used economically for deliveries of less than 3000 liters per minute, more particularly for deliveries of 400 to 3000 liters per minute. Despite economical construction, the advantages of known screw compressors, such as high quality of compressed air and low environmental pollution, are retained through effective separation of the entrained liquid.

Accordingly a compressor unit is provided, wherein all the component units previously disposed separately from one another are integrated into one compact housing. The compressor housing is at the same time the liquid tank and the liquid separator. In order to achieve effective separation of liquid in a small space, large flow cross-sections are provided in the housing for the mixture of liquid and compressed air which pass out of the compressor at a high velocity. In order that the flow may be calmed and slowed down as much as possible, the compressed air is deflected several times to completely utilize the flow path available in the housing. Because of the arrangement of the housing, preseparation of liquid is effected in the region of the sump of liquid. Thereaftr the fine separation takes place in a separation cartridge incorporated in the housing. At the same time, pipes are provided within the compact housing to direct the cooling and lubricating liquid, in a manner which is advantageous for high output of the compressor and for operational reliability. The compact construction results in inexpensive manufacture and assembly of the compressor plant, thus permitting the economic use of a screw compressor even for small deliveries.

Advantageous arrangements of the compressor plant of the invention are indicated in the description and claims.

Exemplified embodiments of the invention are explained more fully below with reference to the drawings, in which.

Figure 1:
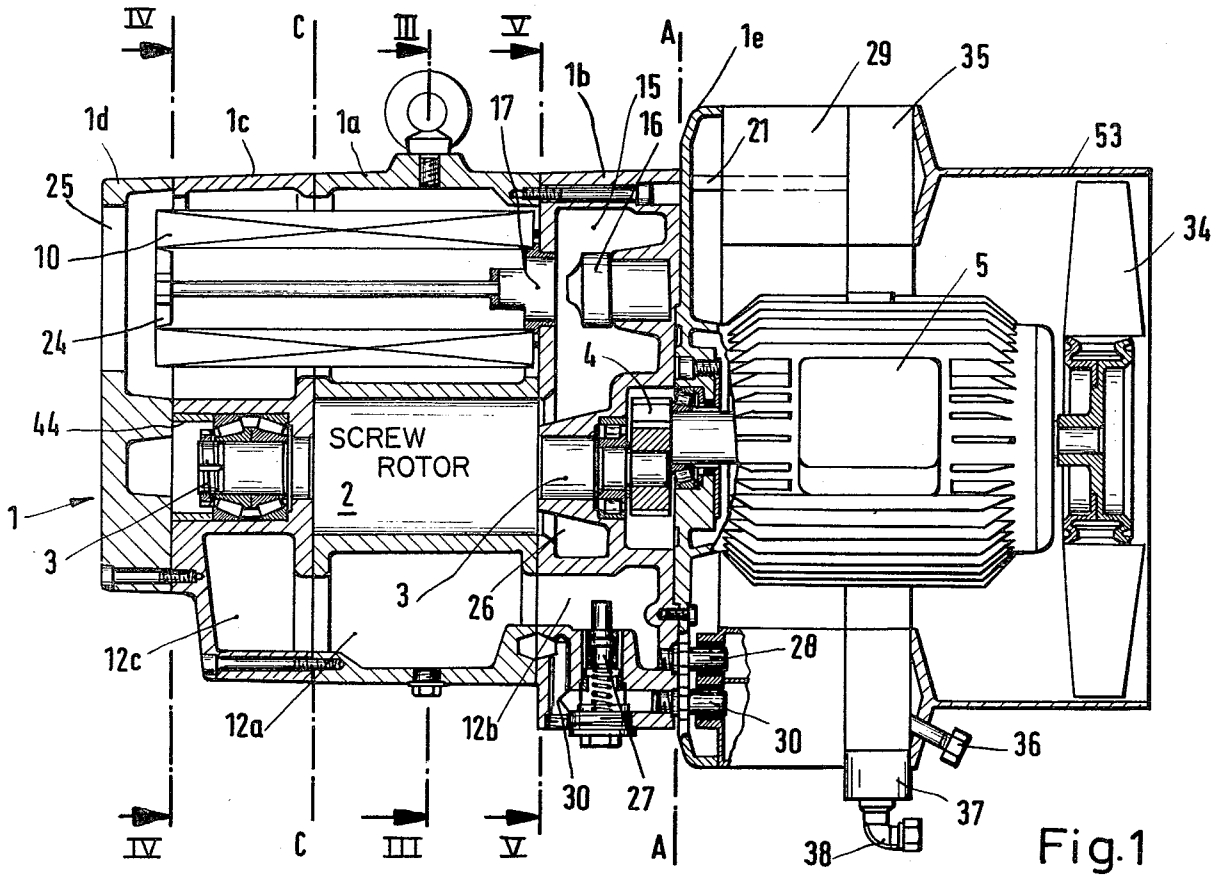
FIG. 1 is a longitudinal section through a compressor plant including a drive motor, the section being taken through the housing on the line I—I in FIG. 4.

In FIG. 1, 1 designates generally a housing which is, for example, produced by casting. The housing 1 is composed of disc-shaped parts divided by dividing planes A—A, B—B, C—C, and D—D lying perpendicularly to the longitudinal axis so as to define a middle part 1*a*, two outer housing parts 1*b* and 1*c*, a cover 1*d*, and a flange part 1*e*. The middle part 1*a* has a length which corresponds to the length of the rotors 2 of a screw compressor. The bearings 3 of the rotors 2 are disposed in the outer housing parts 1*b* and 1*c*. In the housing part 1*b*, at the drive end, is also disposed a gear unit 4, which in the embodiment shown in FIG. 1, is connected directly to an electric motor 5, while in the embodiment shown in FIG. 2 a drive shaft 6 is disposed between this gear unit 4 and the drive motor 5.

Figure 3:
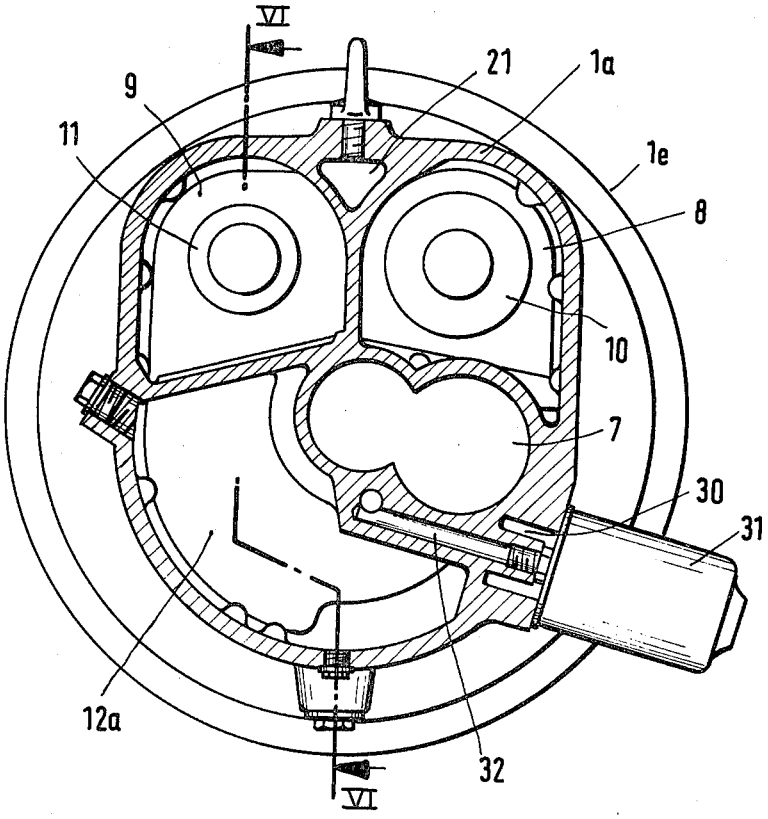
FIG. 3 is a cross-section through the housing on the line III—III in FIG. 1.

As shown in FIG. 3, the intersecting bores 7 for the rotors of the screw compressor are formed in the middle part 1*a* of the housing 1. The bores 7 lie side by side approximately at the height of the horizontal center plane of the housing 1, while the connecting line between the centers of the bores is slightly inclined relative to the horizontal center plane of the housing. On both sides of the vertical center plane of the housing 1 near the upper surface of the housing are a pair of recesses 8 and 9 which are formed so as to extend approximately parallel to the center axis of the housing 1, through the housing parts 1*a* and 1*c* and also into the cover 1*d*. The recess 8, lying above the bores 7, serves to receive a tubular air filter 10, while in the recess 9 a likewise tubular liquid separator 11 is disposed. Below the recess 9 and below the bores 7 a first cavity 12*a* is formed in the housing and extends, with the curved or L-shaped cross-sectional shape visible in FIG. 3, the length of the housing parts 1*a* and 1*b* and also substantially into the housing part 1*c*.

Figure 5:
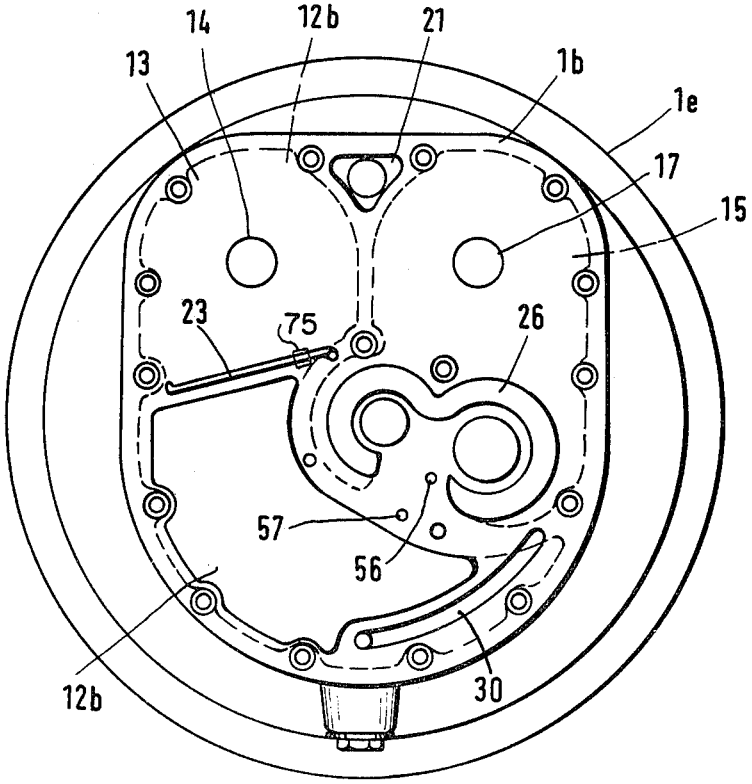
FIG. 5 is an end elevation of the housing part at the drive end, in the dividing plane B—B in FIG. 1.
Figure 6:
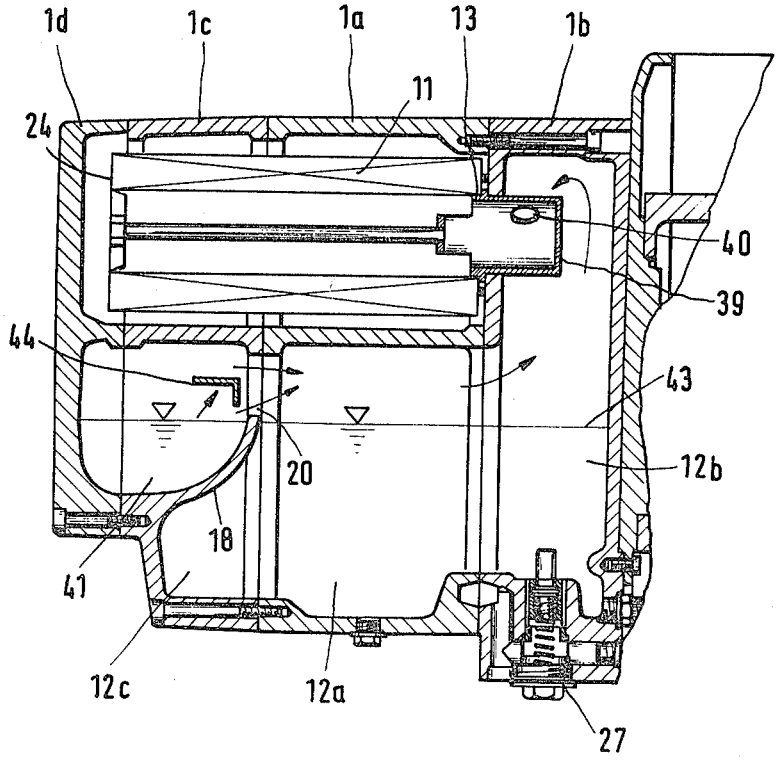
FIG. 6 is a longitudinal section through the housing on the line VI—VI in FIG. 3.

In the housing part 1*b* (FIG. 5) a second cavity 12*b* extends on the left-hand side over the entire height of the housing (FIG. 6). The upper part of this cavity 12*b* is bounded by a side wall 13 in which is formed a bore 14. Into bore 14 is inserted a holder for the liquid separation cartridge 11. This holder has a tubular section 39, which is closed at the right-hand end in order to deflect the compressed air before it enters the separator 11. On the upper side of the holder there are inlet apertures 40 through which the compressed air flows from the cavity 12*b* into the interior of the liquid separator 11.

Above the bores for the rotor bearings a third cavity 15 is formed in the housing part 1*b* (FIG. 1). Into the third cavity 15 a suction regulator 16 is disposed concentric to the axis of the air filter 10. In the side wall of this cavity 15 is formed a bore 17 (FIG. 5), which can be closed and opened by the suction regulator 16. As indicated by broken lines in FIG. 5 and as can also be seen in FIG. 1, this third cavity 15 in the housing part 1*b* extends over a part of the periphery of the rotors. In a continuation of the bores for the rotor bearings 3, the gear unit 4 is able to be accommodated within the housing part 1*b* (FIG. 1).

The first, second and fourth cavities 12*a*, 12*b* and 12*c* are provided in the housing 1 to serve on the one hand as a sump for the liquid and on the other for the separation of liquid. They extend below the bores for the rotor bearings 3 and into the housing part 1*c*. At the side of the rotor bearings a partition 18 is formed in the housing part 1*c* (FIGS. 4 and 6) and defines a chamber 41, which is in communication with the fourth cavity 12*c* by way of at least one connecting opening 19 in the bottom of the chamber 41 and by way of an air passage opening 20 above the partition 18. The flow cross-section of the opening 20 is large and extends almost over the entire width of the left-hand half of the housing 1 (FIG. 4), as is also true of the remainder of the duct, formed by the first and second cavities 12*a* and 12*b* for the flow of the compressed air (FIGS. 3 and 5).

Figure 4:
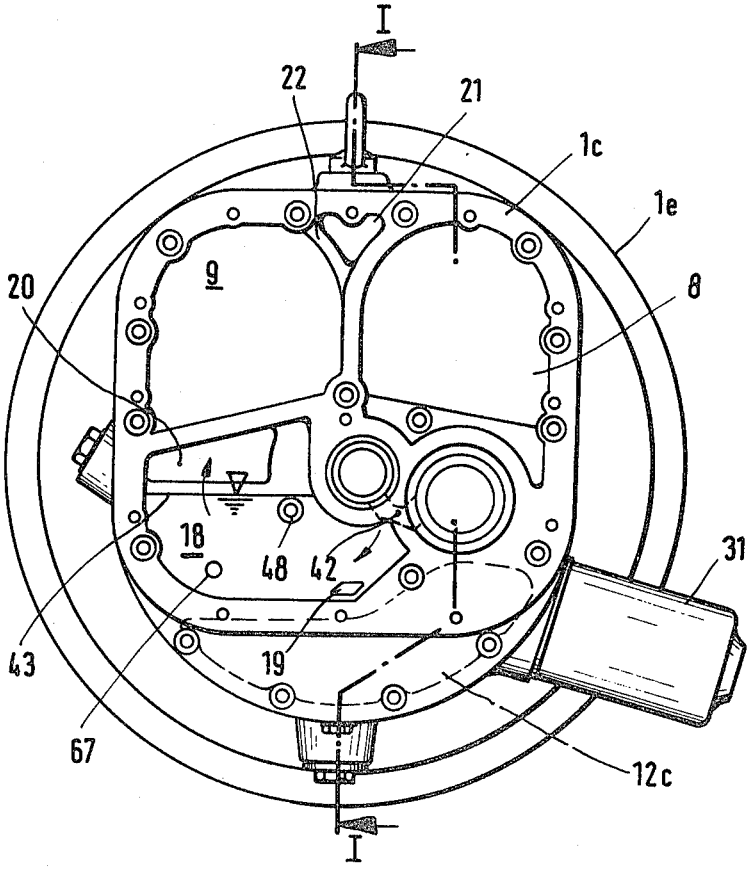
FIG. 4 is an end elevation of the housing with the cover removed, in the dividing plane IV—IV in FIG. 1.

The cross-sectional shape of the housing 1 shown in FIGS. 3–5 is advantageous in respect of thermal stresses. Those regions of the compressor and of the liquid tank which are warmer during operation are situated in the lower part of the housing, in a region of approximately circular or oval cross-section (FIG. 3), while the colder regions of the air filter 10 and of the separation cartridge 11 are disposed symmetrically thereabove. Through the lateral offsetting of the rotors, a large flow cross-section for the compressed air is obtained in one half of the housing 1.

As FIG. 4 shows, the outlet opening 42 on the underside of the compressor is directed obliquely downwards into the chamber 41 (FIG. 6). The liquid level indicated at 43 lies above the outlet opening 42, so that the compressor outlet is flooded by the liquid. Through the injection of the flow of compressed air below the surface of the liquid, the droplets of liquid entrained in the compressed air are slowed down and fixed by liquid in chamber 41. The compressed air, already largely liberated of entrained liquid passes out of the liquid. It is true that the liquid is thus made frothy, but this does not lead to an re-entrainment of liquid into the compressed air. On the contrary, the liquid acts as a kind of preliminary filter. The air passage aperture 20 lies above the liquid level 43, so that the liquid becomes frothy only in the chamber 41, while the surface of the liquid in the cavities 12*a*, 12*b* and 12*c* is relatively calm (FIG. 6).

Through the provision of a smaller chamber 41, which is separate from the remainder of the liquid and which serves as a preseparation chamber, the liquid level 43 can be so arranged that when the compressor is not operating the level 43 lies below the outlet opening 42 of the compression chamber. Whereas during the operation of the compressor the level of liquid rises above the outlet opening 42 in the chamber 41. In this case, the connecting opening 19 (FIG. 4), which lies opposite the outlet opening 42 and leads into the first and fourth cavities 12*a* and 12*c* lying at a lower level, is so arranged that it serves as a throttle for maintaining the level of liquid.

For further improvement of the separation of liquid a baffle and deflection surface 44 is provided immediately in front of the air passage opening 20 in the partition 18, as shown in FIG. 6 in the form of an angled piece of sheet metal. This sheet metal piece deflection surface 44 is so constructed that it covers only part of the air passage opening 20 and that the major part of the flow of compressed air passing out of the liquid strikes against this deflection surface and is deflected. Instead of the sheet metal piece 44, which can be inserted into the chamber 41, a corresponding rib may also be formed on the housing part 1*c*.

Figure 8:
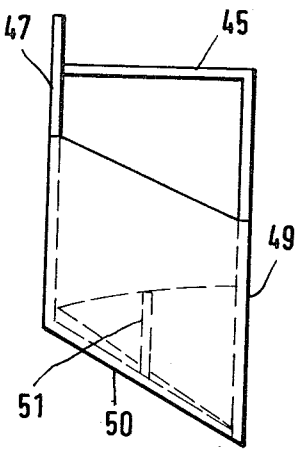
FIG. 8 is an end elevation of the guide element viewed from the left in FIG. 7.
Figure 7:
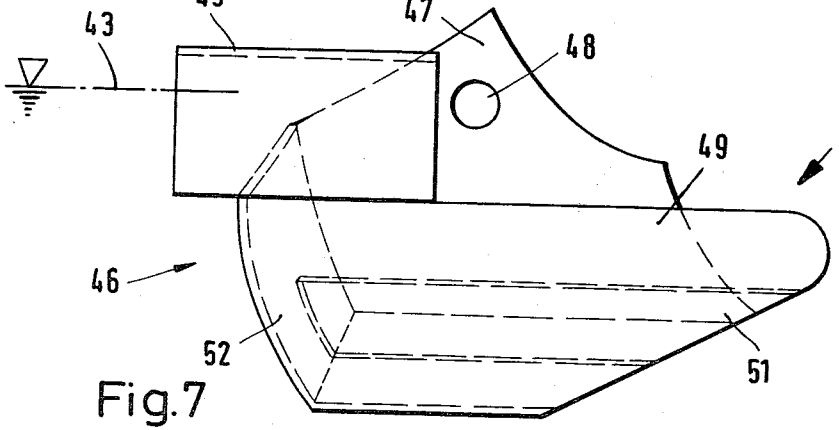
FIG. 7 is a side elevation of a guide element which is disposed adjacent the outlet opening of the compressor, in the liquid sump.
Figure 9:
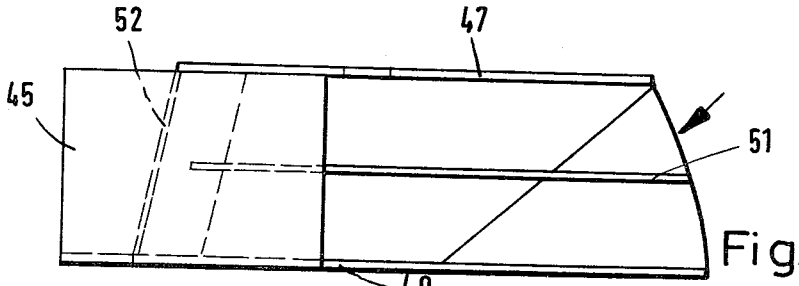
FIG. 9 is a plan view of the guide element shown in FIGS. 7 and 8.

In order that the flow of compressed air passing out of the liquid may be accurately directed against the baffle and deflection surface 44, a guide 46 extending from the outlet opening 42 to a point below the deflection surface 44 is formed in the chamber 41. FIGS. 7–9 show in various views the guide element 46 which is made of sheet metal and is inserted into the chamber 41 or integrally cast in the housing part 1*c*.

The upper transverse surface 45, in conjunction with the side surface 47 of the guide element 46, cooperates with the deflection surface 44 which is shown schematically in FIG. 6. In the side wall 47 is provided a bore 48, by means of which the guide element 46 can be fastened by a screw to the partition 18. The bore 48 (FIG. 4) in the partition 18 corresponds to the bore 48 in the side wall 47 of the guide element 46. A second side wall 49, which has the shape shown in FIG. 7, lies opposite the side wall 47. The side walls 47 and 49 are joined together by a bottom surface 50 which, as shown in FIG. 8, extends obliquely to the upper deflection surface 45 and is adapted to the shape of the chamber 41. The guide element 46 forms a guide channel, which at the top is largely open and in cross-section is roughly U-shaped, between the outlet 42 of the compressor and the air passage opening 20 in the partition 18. The arrangement of the outlet 42 relative to the guide element 46 is indicated by arrows in FIGS. 7 and 9. This guide element 46 is for the most part flooded by the liquid. In FIG. 7 the liquid level 43 is indicated by a dot-dash line 43. The compressed air passing out of the outlet 42 is thus guided under the liquid level 43. The deflection and baffle surface 45, against which the current of compressed air is directed upon exiting from the liquid, is disposed some distance above the level 43.

It has been found advantageous for the flow of compressed air passing out of the outlet 42 to be divided into partial flows. For this purpose a second partition 51 is inserted into the U-shaped channel of the guide element 46 and forms two partial channels as shown in FIG. 8. These channels within guide element 46 are open at the top and are roughly U-shaped in cross-section. Since the flow of compressed air is guided obliquely towards the bottom surface 50 of the guide element, it is sufficient for the partition 51 to be disposed on the bottom surface 50 with only a limited height, as shown in FIGS. 7 and 8. At that end of the guide element 46 which lies opposite the outlet 42, an end wall 52 is provided which directs the current of compressed air upwards to direct the flow of compressed air against the deflection and baffle surface 45.

For the further division of the current of compressed air passing out of the outlet 42 of the compression chamber, the guide element 46 is so constructed that another partial flow is formed between the outside of the guide element 46 and the wall of the chamber 41. This third partial flow is guided by the wall of the chamber 41 upwards in the direction of the air passage opening 20 and the deflection and baffle surface 45. As can be seen in FIGS. 7 and 9, the deflection and baffle surface 45 projects slightly to the left of the guide element 46, in order that this third partial current will also strike against the deflection surface 45. In the region of this third partial current, situated outside the guide element 46, another opening 67 (FIG. 4) is disposed in addition to the connecting opening 19, and likewise serves for communication between the chamber 41 and the cavities 12*a* and 12*c*.

The guide element 46 is so constructed that the entire space available in the chamber 41 is used to the maximum for the flow path of the compressed air, and that the longest possible flow path without dead corners is obtained through deflection.

On the path of the compressed air from the air passage opening 20 to the liquid separator 11, various deflection and baffle surfaces may be provided. It has been found particularly effective to provide a deflection and baffle surface directly in front of the inlet opening of the liquid separator 11, as shown as tubular portion 39 in FIG. 6. Due to the arrangement of the air inlet openings 40 on the upper side of the tubular portion 39, which is closed at one end, the compressed air must flow through the entire second cavity 12*b* as far as the upper part while undergoing multiple deflection, before it can pass into the separation cartridge 11.

The recesses 8 and 9 are curved, in the upper part, to correspond to the circular cross-sectional shape of the air filter 10 and liquid separator 11, while between the curvatures of these recesses 8 and 9 there is formed in the housing 1 a pressure pipe 21 which is roughly triangular in cross-section and which extends over the length of the housing parts 1*c*, 1*a*, and 1*b*. Over the length of the liquid separator 11 this pressure pipe 21 is in communication with the recess 9 through a connecting opening 22, whose cross-section is large in order to lower the flow velocity, or through a plurality of connecting openings 22 spaced apart from one another. The bottom surface of this recess 9 is inclined relative to the horizontal center plane of the housing, so that the liquid dripping off the liquid separator 11 collects in the left-hand bottom part of the recess 9 (FIGS. 3 and 4). As shown in FIG. 5, at the lowest part of the recess 9 a pipe 23 is connected, which leads to the suction side of the screw compressor.

In order to avoid too great a loss of compressed air through this pipe 23, the pipe 23 contains a throttle, which limits the flow of compressed air from the region of the pressure pipe 21 to the suction region of the compressor while allowing the liquid to still be drawn off from the recess 9 due to the pressure differential which exists. This throttle is advantageously in the form of a non-return valve 75 which prevents a mixture of compressed air and liquid from being blown into the liquid separation chamber 9 when, for example, the compressor is shut down and the direction of pressure in the pipe 23 is reversed.

It is advantageous for the pipe 23 to lead out of the recess 9 and into the compression chamber of the compressor at a point where the pressure prevailing is only slightly below the discharge pressure. Because of the resultant small pressure differential, the backflow of compressed air at discharge pressure from the recess 9 is further reduced. There is only a circulation of a small amount of compressed air between the recess 9 and the end compression region of the compressor, whereby the output of the latter is not noticeably affected.

The pipe 23 is formed by a groove in the end face of the housing part 1*b* or housing part 1*c*.

The interior of the air filter 10, like that of the separator 11, is closed at the end face by a cap 24 (FIGS. 1 and 6). The annular space around the air filter 10 is in communication with the atmosphere by way of an opening 25 in the cover 1*d*. Instead of this opening 25 in the cover 1*d*, one or more air inlet apertures may be provided in the region of the housing parts 1*a* and 1*c*. The third cavity 15 in the housing part 1*b* channels the suction air to the bores 7 for the rotors via an opening 26 (FIG. 5). The opening 26 extends over a large part of the periphery of the two rotors.

On the end face of the housing 1 the cover 1*d* covers the recess 9 for the separator 11, the chamber 41, and the two bores in the housing part 1*c* for the rotor bearings 3. On the end face of the cover 1*d*, besides the suction opening 25, pressure gages, temperature indicators and the like (not shown) may be disposed.

Figure 10:
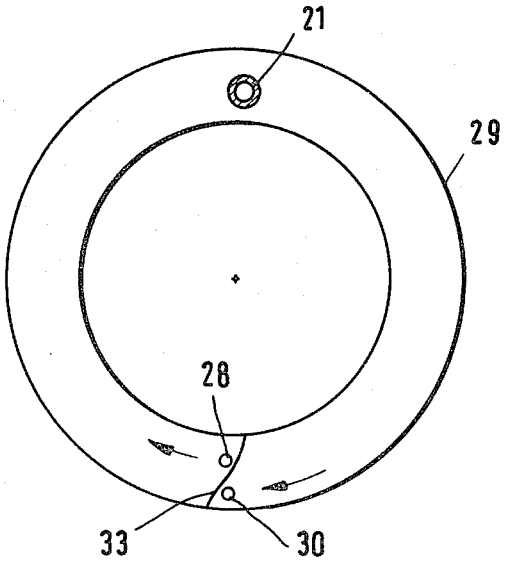
FIG. 10 shows a form of construction of the liquid cooler.

A thermostat valve 27, which projects into the second cavity 12*b* and serves to control the flow of liquid through a cooler 29, is disposed in the bottom region of the housing part 1*b*. In the lower part of the second cavity 12*b* a pipe 28 leads to the annularly shaped liquid cooler 29 (FIG. 10), which is disposed coaxially with the axis of the drive motor 5. The liquid cooler 29 is fastened to the housing part 1*b* by means of the flange part 1*e*. Beside the pipe 28 another pipe 30 leads from the liquid cooler 29, extends through the thermostat valve 27 and terminates at a liquid filter 31 which is fastened at the side to the middle housing part 1*a* (FIG. 3). As shown in FIGS. 1, 3 and 5, the pipe 30 first extends axially through the housing part 1*b*, whereupon it merges into a radial portion leading into a channel which extends over part of the periphery of the housing (FIG. 5). The peripheral channel is formed by grooves in the adjoining surfaces of the housing parts 1*a* and 1*b*. This peripheral channel is connected to an axial portion (not shown) in the housing part 1*a* which in turn is connected to an annular channel which is shown in FIG. 3 and with the liquid filter 31 is in communication. From the liquid filter a pipe 32 leads to a pipe portion (FIG. 3) which extends parallel to the rotors and from which injection openings (not shown) lead into the bores 7. These injection openings may be disposed in the suction region or else in the region of low pressure after closure of the tooth space volume.

The two pipes 28 and 30 are inserted into openings in the liquid cooler 29. Between the two openings a partition 33 extends in the liquid cooler, so that the liquid flowing in through the pipe 28 must flow through the entire liquid cooler before it reaches the outlet opening at the pipe 30.

Figure 2:
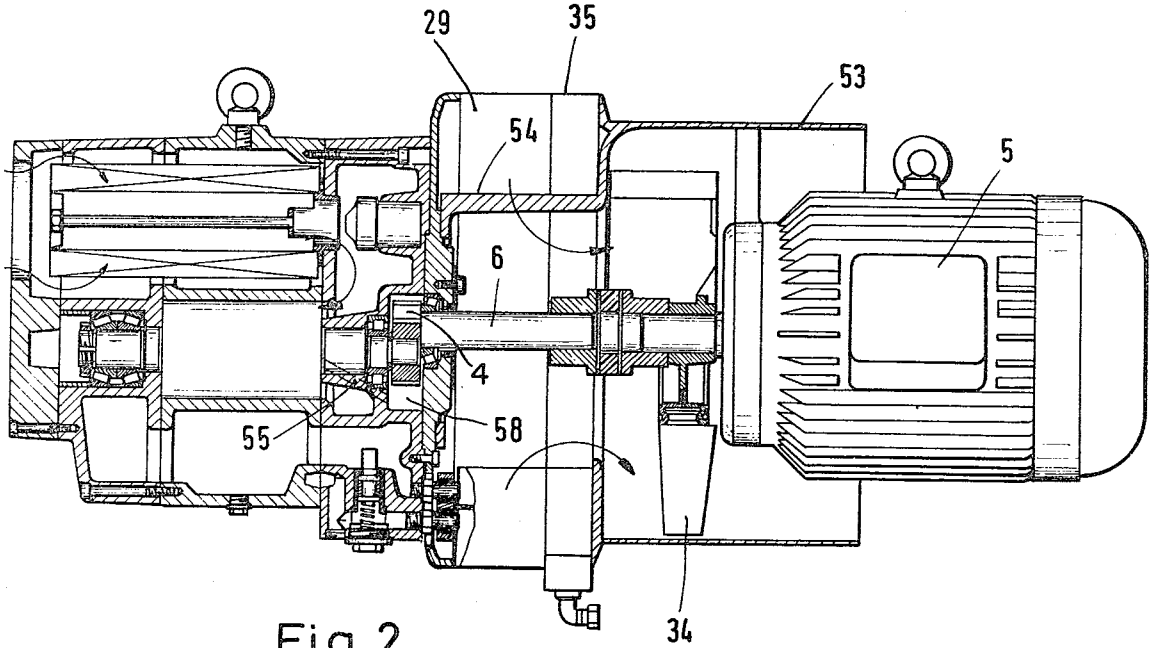
FIG. 2 is a similar view of another embodiment.

An after-cooler 35 for the compressed air is disposed concentrically with and adjoining the liquid cooler 29 (FIGS. 1 and 2). The compressed air flows from the pressure pipe 21 through an extension into the upper part of the after-cooler 35, flows through the latter downwards on both sides to a delivery connection 36. The delivery connection 36 is disposed in a downwardly extended fifth cavity 37 which collects condensate and which is drawn off at 38.

According to FIG. 1 the drive motor 5 is fastened direct to the flange part 1*e*, which is centered relative to the housing part 1*b*. A fan wheel 34 is located on the outside of the motor in a hood 53 surrounding the fan wheel and part of the motor. According to FIG. 2 the fan wheel 34 is positioned between the motor 5 and the housing 1, in the hood 53. The hood 53 guides the flow of cooling air over the periphery of the electric motor 5.

The motor is supported in the hood 53 and the hood 53 is in turn joined by bracing 54 to the flange part 1*e* of the housing 1. In both embodiments (FIGS. 1 and 2), cooling air is drawn in and passes radially through the liquid cooler 29 and the air after-cooler 35, from outside to inside. The hood 53 avoids the danger of overheating caused by the by-passing of the cooling air around the coolers 29 and 35. In this arrangement a conventional motor fan can be dispensed with, thus achieving a saving of power of up to 4%.

During the operation of the compressor, air is drawn in through the air inlet opening 25 and flows axially through the air filter 10 located in the recess 8. Thereafter it passes through the opening 17, the cavity 15 and also through the suction opening 26 in the housing part 1*b* into the suction of the screw compressor. In the suction region of the screw compressor, or in a region of low pressure, liquid is injected through the pipe 32 (FIG. 3). The liquid is under the discharge pressure of the compressor. From the outlet opening 42 of the compressor the mixture of liquid and compressed air flows slightly obliquely into the chamber 41, in which preseparation of liquid from the flow of compressed air is effected. After passing through the opening 20 in the partition 18, the stream of compressed air sweeps along the upper boundary wall of the first cavity 12*a* (FIG. 3), during which time a further separation of liquid can take place. Thereafter the flow of compressed air, on reaching the second cavity portion 12*b* in the housing part 1*b*, is deflected upwards behind the side wall 13 (FIG. 5) and, after further deflection by the holder tubular section 39, passes through the apertures 40 and into the interior of the liquid separator 11. The flow of compressed air, largely freed from liquid, flows through the liquid separator 11 radially from inside to outside and passes through the openings 22, which are spaced apart from one another, into the pressure pipe 21. Because of the large flow cross-section of the openings 22 and because of the annular recess 9 surrounding the liquid separator 11, the flow velocity in the recess 9 remains low. The liquid separated in the separator 11 drops mainly off the lower side of the separator 11. On the one hand because of the low velocity of the flow of compressed air in the recess 9, and on the other hand because of the arrangement of the connecting openings 22 in the upper part of this recess 9 opposing the collecting region, the liquid dripping off at the bottom is not re-entrained by the compressed air. The compressed air passes from the pressure pipe 21 into the after-cooler 35. Condensate, which may form in the after-cooler 35, collects in the bottom cavity 37 and can be drawn off at 38. The compressed air passes out at 36 in a purified state.

In order to improve the output of the compressor, the lubricating liquid is drawn off from the gear unit 4, not in the usual way into the suction duct of the compressor upstream of the suction opening 26, but through a pipe 55 (FIG. 2) which leads direct from the gear unit chamber into the compression chamber of the compressor. Pipe 55 is connected at a point where the pressure prevailing is lower than the pressure in the gear unit chamber. By drawing off the lubricating liquid from the gear unit chamber direct into the compression chamber, the air flow in the suction region is not disturbed. Furthermore there is also an increase in the volume of air drawn in upstream of the suction opening 26. The warm lubricating liquid from the gear unit cannot heat the air upstream of the suction opening. Thus, a larger quantity of colder air passes into the compression chamber, whereby the power of the compressor is improved.

The pipe 55 advantageously leads into the compression chamber at a point adjoining the suction opening, as shown at 56 in FIG. 5. This entry point 56 is so disposed that the mouth of the pipe 55 is unblocked by the rotors as soon as their control edge separates the compression chamber from the suction opening 26. In the compression chamber which has just been closed the suction pressure, which ensures that the lubricating liquid is drawn out of the gear unit, still prevails, even though there is no communication with the suction chamber 15.

The lubricating liquid passes into the gear unit chamber through an extension of the injection channel 32, which, in FIG. 3, extends parallel to the rotors. In FIG. 5 the extension of the injection channel leading to the gear unit 4 is shown at 57.

The cooling and lubricating liquid, which is injected into the compression chamber between the rotors and which lubricates not only the gear unit 4 but also the rotor bearings on the drive side, is according to the invention also guided through the rotor bearings lying on the pressure side of the compressor, as will be explained with reference to FIG. 11.

Figure 11:
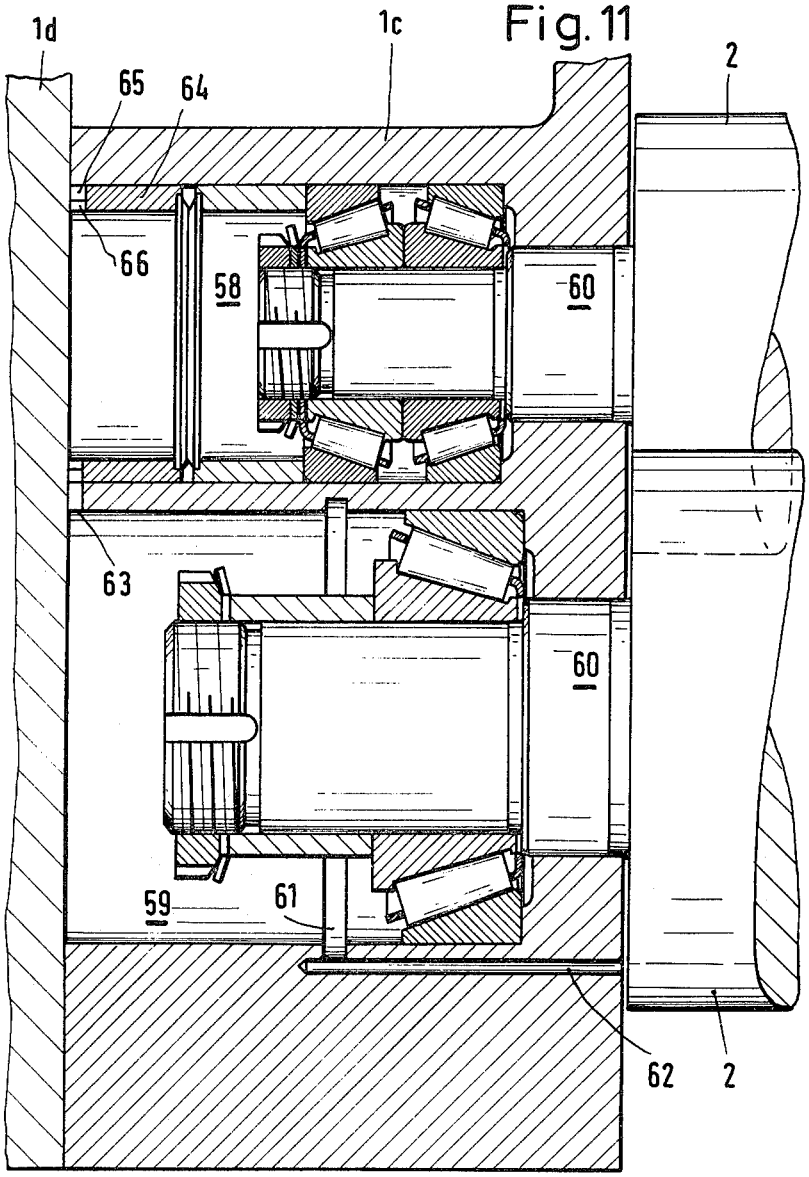
FIG. 11 is a section through the rotor bearings on the pressure side of the compressor, illustrating the guiding of the lubricating liquid.

FIG. 11 shows, in a section through the housing part 1*c*, a bearing bore 58 for the bearing, comprising two tapered roller bearings, of the female rotor 2, and also shows, at the side thereof, a larger bearing bore 59 for the bearing of the male rotor, comprising a single tapered roller bearing and in which, in contrast to the female rotor, the direction of draught is fixed during operation. Because of the difference in pressure between the pressure chamber between the two rotors 2 and the outside of the bearings, lubricating liquid penetrates from the pressure chamber along the periphery of the shaft ends 60 into the bearing bores 58 and 59, so that the bearings are lubricated. In order to discharge the lubricating liquid there is formed on the inner periphery of the bearing bore 59 an annular groove 61 which, by way of a pipe 62 formed in the housing part 1*c*, is in communication with the pressureless outside of the male rotor 2. During the operation of the compressor the lubricating liquid in the bearing bore 59 is thrown outwards by centrifugal force, whereupon the lubricating liquid collects in the annular groove 62 and is drawn off through the pipe 62 because of the pressure differential existing in relation to the pressureless outside of the rotor 2.

In order to make it possible for the lubricating liquid collecting in the bearing bore 58 also to be drawn off, a connecting channel 63 is formed between the bearing bores 58 and 59; in the embodiment illustrated this channel is in the form of a groove in the outer end face of the housing part 1*c*. In order to ensure that the connecting channel 63 cannot be covered over on insertion of the sleeve 64 supporting the bearing, the sleeve 64 is provided on its outer end face having an annular shoulder. Formed on the outer periphery of the sleeve is an annular channel 65 which is bounded on the inside by steps 66 disposed at intervals along the periphery. In any position of the sleeve 64 the film of lubricating liquid accumulating on the inner periphery of the sleeve through the action of centrifugal force can therefore pass into the annular channel 65 and thus into the connecting channel 63. In this way a continuous circulation of the lubricating liquid passing out of the compression chamber, through the bearings and back into the compressor, is ensured, so that stagnation of lubricant with a rise in temperature in the bearing region is avoided.

In contrast to the arrangement of the housing described above, partitioning into individual compartments for the various components of the compressor unit may also be arranged differently. Thus, separation chambers may be provided on both sides of an air filter disposed centrally at the top, the rotors being disposed approximately in the middle region of the cross-section of the housing. The flow of the mixture of liquid and air may be guided symmetrically on both sides of the vertical center plane of the housing.

Figure 12:
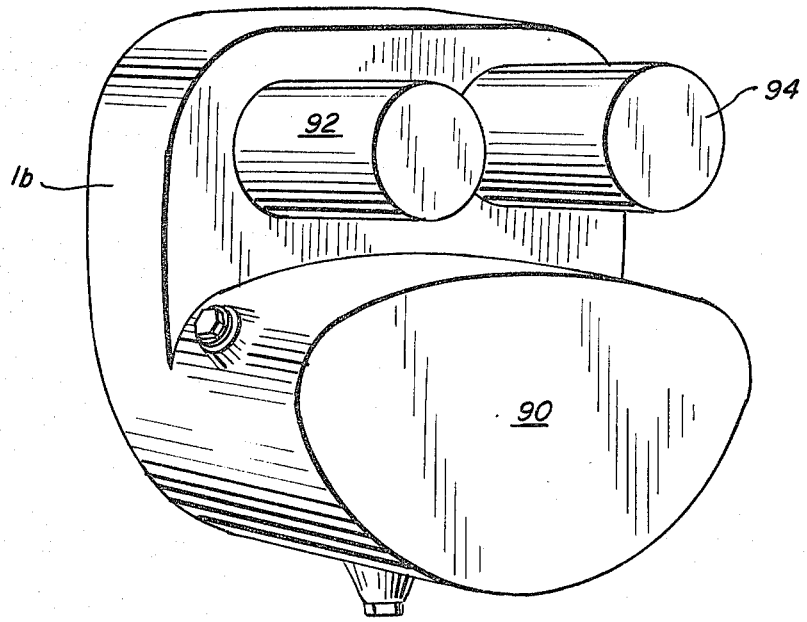
FIG. 12 is a perspective view of an alternate construction of the screw compressor.
Figure 13:
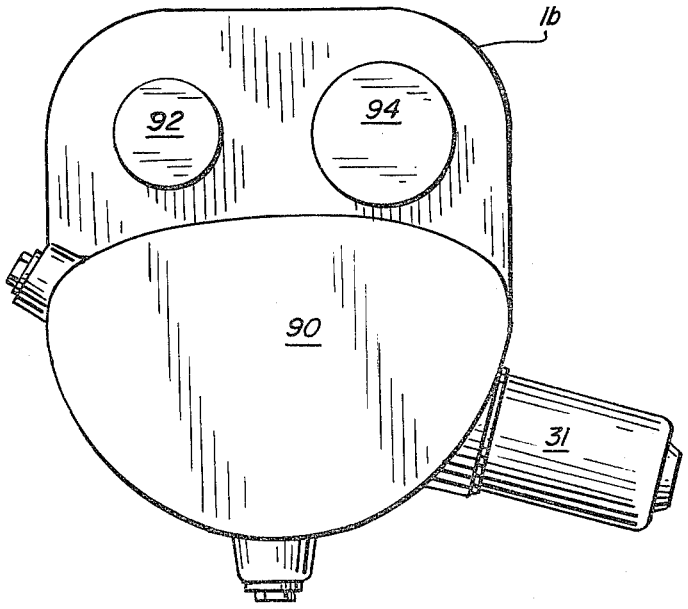
FIG. 13 is an end view of the screw compressor of FIG. 12.

Particularly in the case of a compressor for small outputs, an arrangement may be used in which the air filter 10 and the liquid separator 11 are of similar construction to the liquid filter 31 and are fastened roughly parallel to the rotors on the housing part 1*b*, so that the upper housing walls surrounding the recesses 8 and 9 can be dispensed with. In an arrangement of this kind a housing part 90 which merely receives the rotors 2 and bearings 3, and which has a cavity formed under the rotors, may be fastened to a disc-shaped housing part 1*b*, while individual pot-shaped housings 92 and 94 for the air filter, liquid separator, and optionally for the liquid filter may be flanged, roughly parallel to the rotors, onto the housing part 1*b* as shown in FIGS. 12 and 13.

The compact construction of a compressor unit according to the invention results in a substantially smaller overall volume than in the case of a conventional compressor plant with units separated from one another, for the same compressor output.

I claim:

1. In a compact compressor apparatus comprising a screw compressor including screw rotors with liquid injection into the compression chamber for cooling and lubrication, having a liquid separator and a liquid collecting tank combined with the screw compressor in a housing that can be disassembled, and including air guide runs in sections parallel to the axes of rotation of the rotors, wherein a first section (8) runs from an air inlet opening (25) to the suction end of the compressor (26), and after a turn round of about 180°, is followed by a second section through the compressor, which after a turn round of about 180° is followed by a third section through the separator, which after a turn round of 180° is followed by a further section up to the connection of an outlet opening for compressed air, characterized in that the third section is formed as a preseparation chamber that extends the length of the housing through the upper part of liquid collecting tank (12,41) and that after a turn round of 180° (12*b*) is followed by a main separation chamber (9) that extends in axial direction above the liquid collecting tank, in which main separation chamber a liquid separator (11) is provided, and an air exit opening (22) in the upper part of the main separation chamber (9).

2. The compressor of claim 1, characterized in that for further improvement of the compactness a tubular air filter (10) is provided in the first section.

3. The compressor of claim 1, characterized in that for further increase of the compactness, the outlet opening (42) of the screw compressor is situated below the liquid surface in the liquid collecting tank (41) and the preseparation chamber lying above the liquid collecting tank runs in an axial direction beside the rotors.

4. The compressor of claim 1, characterized in that for improvement of the oil separation a tubular baffle (39) is provided in front of the air inlet opening at the liquid separator (11), on whose upper circumferential section at least one air opening (40) is provided.

5. The compressor of claim 1, characterized in that a conduit (21) is provided parallel to the main separation chamber (9) on its upper part, which conduit, in order to decrease the speed of the air flow, is provided with several connection openings (22) along its length and is connected with the air outlet opening (36) on the housing.

6. The compressor of claim 1, characterized in that from the bottom of the main separation chamber (9) an outlet pipe (23) leads into the compression chamber between the rotors and that in this outlet pipe (23) a throttle for the compressed air is provided.

7. The compressor of claim 6, characterized in that the throttle in the outlet pipe (23) is formed as a nonreturn valve (75), which when pressure biased from the compressor forms a barrier for the outlet pipe (23) in the direction to the main separation chamber (9).

8. The compressor of claim 1, characterized in that an outlet pipe (55) for the liquid is provided, which directly runs from a gear unit chamber (58) into the compression chamber between the rotors adjacent to the suction opening (26) of the screw compressor.

9. The compressor of claim 1, characterized in that the housing (1) includes a plate-like middle part (1*a*), which has a length dimension that corresponds to the rotor length.

10. The compressor of claim 1, characterized in that an annular radial-flow liquid cooler (29) is fixed to the housing coaxially to the middle axis of the housing, on which cooler an annular after-cooler (35) for the compressed air is attached with common axis.

* * * * *